United States Patent [19]

Slimmon

[11] Patent Number: 4,698,854

[45] Date of Patent: Oct. 13, 1987

[54] SPORTS ACCESSORY

[76] Inventor: Philip J. Slimmon, 1 Penllwyn Street, Cwmfelinfach, Gwent, Wales

[21] Appl. No.: 723,161

[22] Filed: Apr. 15, 1985

[30] Foreign Application Priority Data

Apr. 18, 1984 [GB] United Kingdom ..... 8410172
Oct. 26, 1984 [GB] United Kingdom ..... 8427117

[51] Int. Cl.[4] ..... A41F 3/02; A41B 13/10

[52] U.S. Cl. ..... 2/338; 2/319; 2/247; 2/48; 15/222

[58] Field of Search ..... 2/338, 319, 311, 312, 2/247, DIG. 11, 48; 15/222

[56] References Cited

U.S. PATENT DOCUMENTS

| | | | |
|---|---|---|---|
| 1,922,169 | 8/1933 | Martin | 15/222 |
| 1,990,568 | 2/1935 | Scheidler | 15/222 |
| 2,754,533 | 7/1956 | Swartout | 15/222 |
| 3,040,357 | 6/1962 | Belleni . | |
| 3,161,887 | 12/1964 | Silver . | |
| 3,760,461 | 9/1973 | Wright . | |
| 3,977,796 | 8/1976 | Gillespie et al. | 15/222 X |
| 4,079,871 | 3/1978 | Sica | 2/247 X |
| 4,224,712 | 9/1980 | Black et al. . | |
| 4,446,574 | 5/1984 | Kalomeris | 2/338 |
| 4,459,703 | 7/1984 | Kosmas et al. | 2/338 X |
| 4,472,839 | 9/1984 | Johansen | 2/319 X |

FOREIGN PATENT DOCUMENTS 2065449 7/1981 United Kingdom .

*Primary Examiner*—Ronald Feldbaum
*Assistant Examiner*—J. L. Olds
*Attorney, Agent, or Firm*—Banner, Birch, McKie & Beckett

[57] ABSTRACT

A sports accessory which can be used as a towel comprises a sheet of absorbent material which can be folded along lines (6) in a concertina fashion to form an elongate portion. The accessory may be in the form of a belt provided with an end region (1*a*) having a buckle (2) and, at the other end, a flap (3) which, with the sheet folded into the form of a belt, can be passed through buckle (2) for securing around the waist of a wearer.

In another embodiment, the pleated sheet is permanently secured in the form of an elongate portion, but can be opened out for use as a towel for wiping hands and/or face of a person taking exercise. This embodiment may be used as a belt or may be provided with attachment means for attachment to sports equipment.

6 Claims, 10 Drawing Figures

FIG.1.
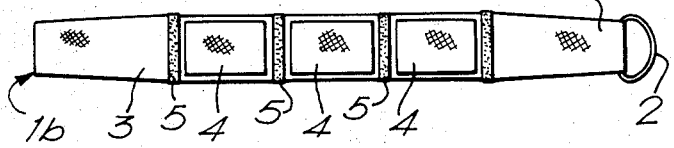
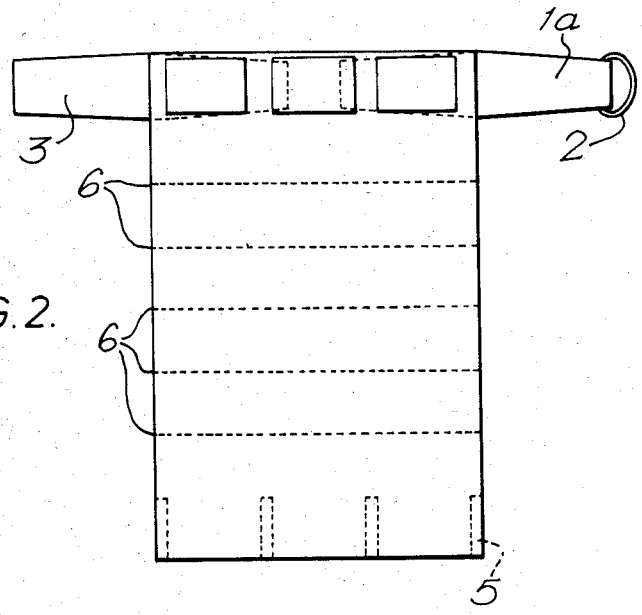
FIG. 2.
FIG.3.
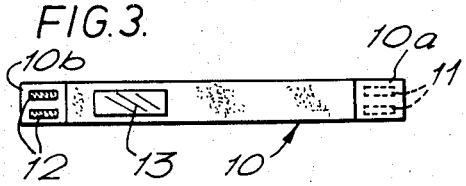
FIG.4.
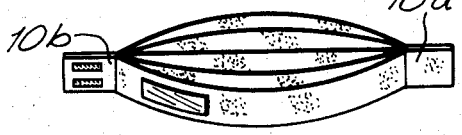

SPORTS ACCESSORY

This invention relates to a sports accessory.

In accordance with one aspect of the present invention there is provided a sports accessory comprising a piece of absorbent material, which can be used as a towel, provided with a plurality of generally parallel fold lines along which the piece is or can be folded back and forth to form an elongate portion, there being a respective end region at each end of the elongate portion, one end region being provided with an attachment means whereby the towel can be attached to sports equipment, there being securing means capable of securing the folded piece of material in the form of said elongate portion, the securing means being such that the piece of absorbent material can be opened out for use as a towel.

One face of the elongate portion may bear an advertising slogan or manufacturer's name in such a manner as to be clearly visible when the accessory is attached to sports equipment. In particular, the accessory may be used with golf equipment and may be suspended from a golf bag.

A sports accessory may also be in the form of a belt. Thus, in accordance with another aspect of the present invention there is provided a belt comprising a piece of absorbent material provided with a plurality of generally parallel folded lines along which the piece is or can be folded back and forth to form an elongate belt portion, there being a respective belt end region at each end of the elongate belt portion, each belt end region being provided with complementary fastening means whereby the belt can be fastened around the waist of a wearer, there being securing means capable of securing the folded piece of material in the form of said elongate belt portion, the securing means being such that the piece of absorbent material can be opened out for use as a towel.

In one embodiment, said securing means is permanent and comprises first and second securing elements disposed just inwardly respectively of each end region (for example the pleated sheet is sewn at its edges in the form of the elongate portion) so that, when the accessory, or belt, is to be used as a towel, an increased surface area is available without the belt becoming dismantled.

In another embodiment, particularly applicable where the accessory is in the form of a belt, the securing means is temporary so that, when the belt is to be used as a towel, the piece of material may be fully unfolded so that it can be used entirely as a conventional towel. In this embodiment, the securing means comprises a plurality of removable securing devices spaced along the elongate belt portion so that, with the securing devices having been removed, the piece can be completely unfolded.

Each belt and region may extend from the respective end of the elongate belt portion.

Preferably, the belt is provided with one or more pockets.

The fastening means preferably comprises hook and loop, touch and close fasteners. The piece of material may be generally rectangular apart from any projecting regions intended to form the belt end regions; however, it will be appreciated that any suitable shape may be adopted. For example, it would be possible to construct the piece of material in the shape of a particular island, country or other geographical area, to be retained as a souvenir of that area.

The belt according to the one embodiment of the present invention is particularly useful for sportsmen, as the belt may be worn around the waist of a sportsman, and used for wiping his hands and/or face during exercise, with the minimum of trouble. After use of the towel for wiping, the towel is restored to its belt configuration simply by pulling the belt end regions.

The other embodiment, where the piece of material can be completely unfolded, can serve, in addition to a towel, as a beach mat, since it can be placed completely flat on a surface. The temporary securing means may comprise strips of the absorbent material or of another material for passing around the width of the elongate belt portion. When formed, the strips have, at their ends further complementary fastening means whereby the elongate belt portion is maintained.

The width of the elongate portion is substantially perpendicular to its length and corresponds to the spacing between a pair of adjacent fold lines. The fold lines may be equally spaced, or the spacing may vary over the piece of material. The piece of material may, for the belt, be a rectangle of about 36" (91.5 cm)×55" (140 cm) in size, with protruding regions to form the belt end regions.

For a better understanding of the present invention, and to show how the same may be carried into effect, reference will now be made, by way of example, to the accompanying drawings, in which:

FIG. 1 shows a belt in accordance with one embodiment of the present invention, ready for wear;

FIG. 2 shows the belt of FIG. 1 opened out for use as a beach mat;

FIG. 3 shows a belt in accordance with another embodiment of the present invention, ready for wear;

FIG. 4 shows the belt of FIG. 3, opened out for use as a towel;

Figure 5A:
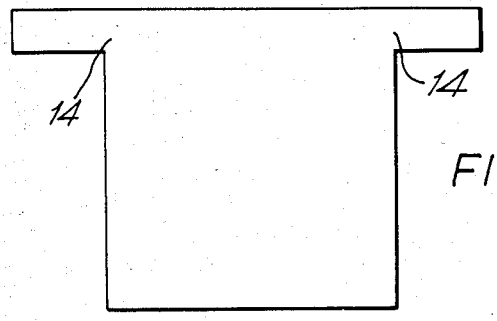
Figure 5B:
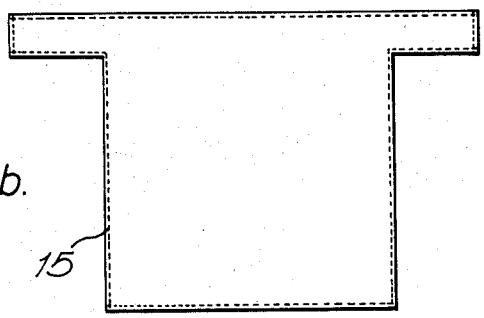
Figure 5C:
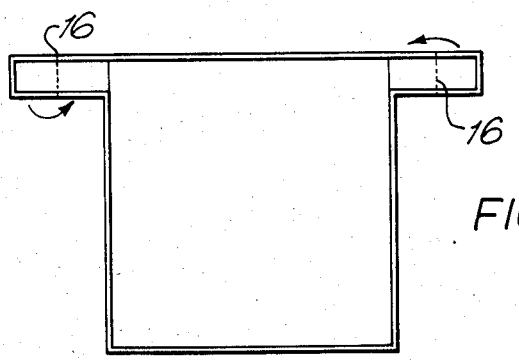
Figure 5D:
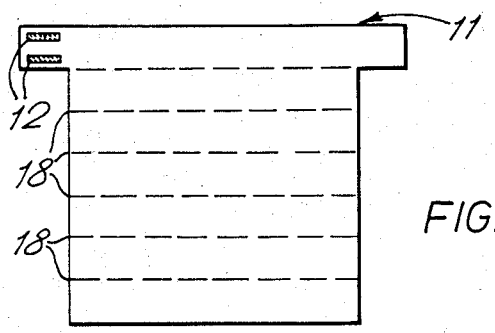
Figure 5E:
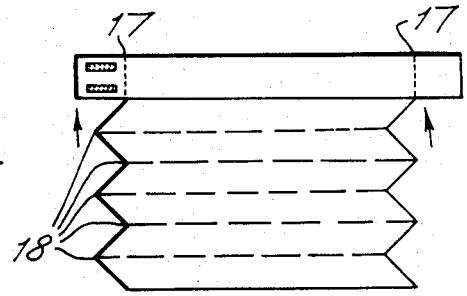
Figure 6:
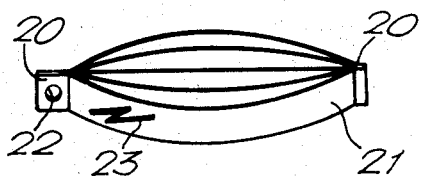

FIGS. 5*a* to 5*e* show stages in preparation of the belt shown in FIG. 3; and FIG. 6 shows a sports accessory in accordance with another embodiment of the present invention, partially opened out.

FIG. 1 shows a belt 1 having at one end region 1*a* a buckle, for example in the form of a plastic ring 2. At the other end region 1*b* of the belt 1 there is a flap 3 which, when the belt is worn by a wearer, passes through the buckle 2 and may be secured in a conventional manner, for example using a hook and loop, touch and close fastener such as VELCRO. The belt 1 is provided with pockets 4 for carrying, for example, sun glasses, swimming costumes, money, make-up, combs etc when the belt is worn by a wearer.

As shown in FIG. 1, the belt is ready for wear, with strips of towelling 5 passing round the width of the belt and secured with a suitable fastening means, for example a hook and loop, touch and close fastener such as VELCRO. FIG. 2 shows the belt when it has been unfolded. The belt is formed of a rectangular piece of absorbent material 7, for example towelling, across the width of which have been sewn, spaced apart, lines 6. Toweling strips 5 extend from the end of rectangular absorbent material 7 opposite belt 1. The towelling strips 5, flap 3 and region 1*a* are folded underneath the unfolded belt, as indicated by hatched lines. In the form shown in FIG. 2 the belt thus serves as a towel which, when used as a beach mat, has a slightly pillowed portion by virtue of the region 1*a* and the flap 3 being turned under the piece of material 7.

When the belt is to be worn, the piece of material 7 is simply folded in a "concertina" manner along the sewn lines 6 and is secured with the towelling strips 5 to form the belt of FIG. 1.

FIG. 3 shows a belt in accordance with another embodiment of the present invention. The belt 10, shown in FIG. 3 in its ready-to-wear form, has an end region 10*a* provided with two strips of a hook and loop, touch and close fastener such as VELCRO 11 on an underside thereof, and an end-region 10*b* having two strips of a hook and loop, touch and close fastener such as VELCRO 12 on an upper side thereof whereby the belt can be attached around the waist of a wearer. This belt is provided with one pocket 13 only. FIG. 4 shows the belt in its opened form from which it can be seen that, in contrast to the embodiment shown in FIGS. 1 and 2, the belt does not unfold fully, but merely opens out so that it can be used as a towel for hands and face. This belt is intended to be worn by a sportsman, or someone taking exercise. The belt is comfortable and unobtrusive to wear, but, when required, opens out to provide an increased surface area for use as a towel.

As shown in FIGS. 5*a* to 5*e*, the belt of FIG. 3 is formed by providing a substantially T-shaped piece of absorbent material, for example towelling, and cutting inwardly at two of the upper corners 14. As shown in FIG. 5*b*, a hem 15 is sewn around the periphery of the T-shaped piece of material, after which, as shown in FIG. 5*c*, outer ends of each of the cross bar of the T are folded in along lines 16 to form regions 10*a* and 10*b*. The strips of a hook and loop, touch and close fastener such as VELCRO 11 and 12 are sewn at the end regions, and fold lines are formed by pressing or sewing the material along lines 18. In the embodiment shown in FIG. 5*d*, there are six lines 18, equally spaced. However, the number and spacing of the fold lines will vary according to requirements. Also, as illustrated, the belt end regions 10*a*, 10*b* are disposed at one end of the piece of material; however, it would be possible to have these regions extending from a central region of the piece of material, which could then be folded from each end towards the central region to form the elongate belt portion. As shown in FIG. 5*e*, the piece is folded back and forth in a concertina-like manner along lines 18. Finally the folded material is permanently secured, for example by sewing, at lines 17 situated just inward of the a hook and loop, touch and close fastener such as VELCRO strips 11 and 12 to provide the belt shown in FIG. 3.

While the fastening means for the belt, and towelling strips 5, are described herein as being hook and loop, touch and close fasteners it will be appreciated that any suitable type of fastener may be used, for example hook and eyes or press studs.

FIG. 6 shows a sports accessory for attachment to sports equipment. The accessory is formed in a similar manner to the belt as described with reference to FIGS. 5*a* to 5*e*, except that the material is secured along lines substantially at the outermost end regions 20 of the elongate portion 21. An attachment means in the form of, for example, an eyelet 22 is provided at one end region 20 of the accessory, whereby the accessory can be suspended from sports equipment, e.g. a golf bag. The accessory has an advantage over conventional sports towels in that, while it is in the folded configuration and suspended from sports equipment, one face of the accessory is always visible. This face could bear a manufacturer's name or advertising loop 23, for example to indicate the sponsors of the sport concerned.

It will be appreciated that an important feature of the belt and accessory hereinbefore described is the formation of the elongate portion by folding back and forth to produce a concertina effect. This means that, after use of the opened out piece of material as a towel, its end regions need only be tugged away from one another to cause the piece of material to immediately resume the form of the elongate portion.

I claim:

1. A towel-belt comprising:

a folded piece of absorbent material having a plurality of substantially parallel fold lines, said material being folded back and forth along said fold lines to form said towel-belt having two end regions;

means for permanently securing said end regions of said towel-belt to allow said material to partially unfurl and present an increased surface area for use as a towel without dismantling said end regions of said towel-belt; and complementary fastening means for fastening together said end regions of said towel-belt.

2. A towel-belt as set forth in claim 1 wherein said securing means comprises stitching.

3. A towel-belt as set forth in claim 1 further comprising at least one pocket.

4. A towel-belt as set forth in claim 1 wherein said piece of absorbent material is substantially rectangular.

5. A towel-belt as set forth in claim 1 wherein said complementary fastening means comprises a hook and loop, touch and close fastener.

6. A towel-belt comprising:

a folded substantially rectangular piece of absorbent material having a plurality of substantially parallel fold lines, said material being folded back and forth along said fold lines to form said towel-belt having two end regions;

means for permanently securing said end regions of said towel-belt to allow said material to partially unfurl and present an increased surface area for use as a towel without dismantling said end regions of said towel-belt, wherein said securing means comprises stitching;

complementary fastening means for fastening together said end regions of said towel-belt wherein said fastening means comprises a hook and loop, touch and close fastener; and at least one pocket disposed in said towel-belt.

* * * * *